US008256050B2

(12) United States Patent
Wong et al.

(10) Patent No.: US 8,256,050 B2
(45) **Date of Patent: *Sep. 4, 2012**

(54) SURGICAL TABLE EXTENSION

(75) Inventors: George T. Wong, Chelmsford, MA (US); Paul A. Licari, Boxborough, MA (US); David Warburton, Lexington, MA (US); Edward J. Daley, II, Maynard, MA (US); Thomas K. Skripps, Acton, MA (US)

(73) Assignee: Allen Medical Systems, Acton, MA (US)

( * ) Notice: Subject to any disclaimer, the term of this patent is extended or adjusted under 35 U.S.C. 154(b) by 230 days.

This patent is subject to a terminal disclaimer.

(21) Appl. No.: 12/417,772

(22) Filed: Apr. 3, 2009

(65) Prior Publication Data

US 2009/0199340 A1 Aug. 13, 2009

Related U.S. Application Data

(63) Continuation of application No. 11/229,759, filed on Sep. 19, 2005, now Pat. No. 7,520,008.

(60) Provisional application No. 60/626,627, filed on Nov. 10, 2004.

(51) Int. Cl.
*A47B 23/00* (2006.01)

(52) U.S. Cl. ..... 5/648; 5/624; 5/621; 5/651

(58) Field of Classification Search ..... 5/613, 617, 5/618, 722, 621–624, 630, 648, 649, 651, 5/658, 661

See application file for complete search history.

(56) References Cited

U.S. PATENT DOCUMENTS

| | | | | |
|---|---|---|---|---|
| 2,688,142 | A | 9/1954 | Jensen | |
| 2,872,259 | A * | 2/1959 | Thorpe | 5/613 |
| 3,042,025 | A | 7/1962 | Jackson | |
| 3,493,225 | A | 2/1970 | Ceraldi | |
| 3,947,686 | A | 3/1976 | Cooper et al. | |
| 4,033,339 | A | 7/1977 | Roberts et al. | |
| 4,054,282 | A * | 10/1977 | Hamer | 5/610 |
| 4,139,917 | A | 2/1979 | Fenwick | |
| 4,225,125 | A | 9/1980 | Lee | |
| 4,239,200 | A | 12/1980 | Sarrafian et al. | |
| 4,391,438 | A | 7/1983 | Heffington, Jr. | |
| D271,834 | S | 12/1983 | Huntsinger | |
| 4,474,364 | A | 10/1984 | Brendgord | |
| 4,506,872 | A | 3/1985 | Westerberg et al. | |
| 4,527,555 | A | 7/1985 | Ruf | |
| 4,527,787 | A | 7/1985 | Collis, Jr. | |
| 4,558,857 | A | 12/1985 | Heller | |
| 4,562,588 | A | 12/1985 | Ruf | |

(Continued)

OTHER PUBLICATIONS

"2005 Catalog Passionate About Positioning", Allen Medical Systems, A Hill-Rom Company; ©, date Dec. 2004.

(Continued)

*Primary Examiner* — William Kelleher
(74) *Attorney, Agent, or Firm* — Barnes & Thornburg LLP

(57) ABSTRACT

A surgical table extension features a patient support structure, a large area base, and a support leg. A first joint having at least two degrees of freedom is located between the patient support structure and the support leg. A second joint also having at least two degrees of freedom is located between the base and the support leg. There is a stop limiting the range of motion of the support leg such that a portion of the base area is constrained to be below the first joint irrespective of the position of the base.

20 Claims, 16 Drawing Sheets

U.S. PATENT DOCUMENTS

| | | | | |
|---|---|---|---|---|
| 4,616,813 | A | | 10/1986 | McConnell |
| 4,635,914 | A | | 1/1987 | Kabanek |
| 4,653,482 | A | | 3/1987 | Kurland |
| 4,662,619 | A | | 5/1987 | Ray et al. |
| 4,671,728 | A | | 6/1987 | Clark et al. |
| 4,712,781 | A | | 12/1987 | Watanabe |
| 4,752,064 | A | | 6/1988 | Voss |
| 4,840,363 | A | | 6/1989 | McConnell |
| 4,872,656 | A | | 10/1989 | Brendgord et al. |
| 4,989,848 | A | * | 2/1991 | Monroe ..... 5/621 |
| 4,995,067 | A | | 2/1991 | Royster et al. |
| 5,088,706 | A | | 2/1992 | Jackson |
| 5,131,106 | A | | 7/1992 | Jackson |
| 5,444,882 | A | | 8/1995 | Andrews et al. |
| 5,520,623 | A | | 5/1996 | Williams |
| 5,535,466 | A | | 7/1996 | Snell |
| 5,613,254 | A | * | 3/1997 | Clayman et al. ..... 5/600 |
| 5,628,078 | A | | 5/1997 | Pennington et al. |
| 5,655,238 | A | | 8/1997 | Stickley et al. |
| 5,658,315 | A | | 8/1997 | Lamb et al. |
| 5,675,851 | A | | 10/1997 | Feathers |
| 5,758,374 | A | * | 6/1998 | Ronci ..... 5/507.1 |
| 5,926,876 | A | | 7/1999 | Haigh et al. |
| D414,974 | S | | 10/1999 | Marrone, II et al. |
| 6,001,076 | A | | 12/1999 | Wilson et al. |
| 6,003,174 | A | | 12/1999 | Kantrowitz et al. |
| 6,120,397 | A | | 9/2000 | Julian |
| 6,195,820 | B1 | | 3/2001 | Heimbrock et al. |
| 6,199,233 | B1 | | 3/2001 | Kantrowitz et al. |
| 6,199,552 | B1 | | 3/2001 | Crespo |
| 6,237,172 | B1 | | 5/2001 | Morgan, Sr. |
| 6,260,220 | B1 | | 7/2001 | Lamb et al. |
| 6,295,671 | B1 | | 10/2001 | Reesby et al. |
| 6,336,412 | B2 | | 1/2002 | Heimbrock et al. |
| 6,526,609 | B2 | | 3/2003 | Wong |
| 6,557,195 | B2 | | 5/2003 | Dinkler |
| 6,584,630 | B1 | | 7/2003 | Dinkler |
| 6,637,058 | B1 | | 10/2003 | Lamb |
| 6,813,788 | B2 | | 11/2004 | Dinkler et al. |
| 7,017,211 | B2 | | 3/2006 | Krywiczanin et al. |
| 7,520,008 | B2 | | 4/2009 | Wong et al. |
| 2004/0133979 | A1 | | 7/2004 | Newkirk et al. |
| 2004/0133983 | A1 | | 7/2004 | Newkirk et al. |
| 2005/0160533 | A1 | * | 7/2005 | Boucher et al. ..... 5/647 |
| 2006/0096033 | A1 | | 5/2006 | Wong et al. |

OTHER PUBLICATIONS

"2002 Catalog Advanced Orthopedic Technology", Ronci*Surgical; ©, date 2002.

* cited by examiner

SURGICAL TABLE EXTENSION

RELATED APPLICATIONS

This application is a continuation of U.S. application Ser. No. 11/229,759, filed Sep. 19, 2005, now U.S. Pat. No. 7,520,008, which claimed the benefit of U.S. Provisional Application No. 60/626,627, filed Nov. 10, 2004, the disclosures of each of which are hereby incorporated by reference herein.

FIELD OF THE INVENTION

This subject invention relates to a surgical table extension.

BACKGROUND OF THE INVENTION

Surgical table extensions are designed to attach to one end of a conventional surgical table in order to X-ray a patient, perform spine fixation procedures, and to perform other medical procedures. U.S. Pat. No. 4,995,067 shows a surgical table extension with a wheeled based and an extendable and retractable leg pivotably attached to one end of a patient support platform allowing it to tilt laterally with the surgical table. The applicant hereof has designed and offers for sale various different table extensions with an extendable and retractable leg.

For certain medical procedures, it is desirable that the table extension tilt laterally and also flex upwardly and downwardly (for Trendelenburg, reverse Trendelenburg, and flex positioning) all the while providing adequate support for the patient. An optimal design would allow the table extension to be stored compactly, easily transported to the surgical table and secured thereto, and then easily dismantled, folded, and transported back to storage.

SUMMARY OF THE INVENTION

It is therefore an object of this invention to provide a surgical table extension which provides adequate patient support irrespective of the lateral tilt or flex position of the table.

It is a further object of this invention to provide such a table extension designed so the base cannot be accidentally placed into a position wherein the table is no longer able to support a patient.

It is a further object of this invention to provide such a table extension designed so that the support leg does not suffer from moments or other loads which could lead to failure and/or the inability to adequately support a patient.

It is a further object of this invention to provide such a table extension which is designed to be compactly stored.

It is a further object of this invention to provide such a table extension which can be easily transported.

It is a further object of this invention to provide such a table extension which is easy to deploy and easy to attach to a surgical table.

It is a further object of this invention to provide such a table extension which is easy to dismantle from the surgical table and easy to fold for transport.

The subject invention, in one preferred embodiment, results from the realization that a large area base attached to the support leg of a surgical table extension and designed to limit the range of motion of the base with respect to the support leg while still providing lateral tilt and flexing ensures the table extension adequately supports the patient and further reduces moments and loads placed on the support leg. The subject invention results from the further realization that the extension table is easier to store and transport if it is designed to include an integral cart.

The subject invention, however, in other embodiments, need not achieve all these objectives and the claims hereof should not be limited to structures or methods capable of achieving these objectives.

In one example, a surgical table extension, in accordance with the subject invention, includes a patient support structure, a large area base, and a support leg. There is a first joint having at least two degrees of freedom located between the patient support structure and the support leg and a second joint having at least two degrees of freedom located between the base and the support leg. A stop limits the range of motion of the support leg such that a portion of the base area is constrained to be below the first joint irrespective of the position of the base.

In the preferred embodiment, the first and second joints are U-joints. There may be a first bracket attached to the patient support structure, a second bracket attached to the support leg, and the first joint is disposed between the first and second brackets. Typically, the large area base includes a U-shaped bottom. The base can include wheels offset upwardly on the base for transporting the table extension when the base is tilted. In the preferred embodiment, a plate is integral with the base and has an orifice through which the support leg extends. The stop is defined by the size and/or configuration of the orifice. The plate terminates in a shelf for supporting the patient support structure when folded proximate the support leg.

There is also typically a mechanism for attaching the patient support structure to the surgical table. One example is at least one post insertable into a rail of the surgical table. Another example of an attachment mechanism includes at least one clamp attachable to the surgical table.

The patient support structure may include a platform which can be in two sections joined together by an axle. Another patient support structure includes opposing beams joined via a bracket. In one example, each of the beams include two sections joined together by an axle.

Typically, the support leg includes a plurality of telescoping sections and a crank mechanism for extending and retracting the telescoping sections.

Another surgical table extension in accordance with this invention includes a patient support structure and a large area U-shaped based including at least one wheel offset upwardly and a plate including an orifice and a shelf for supporting the patient support structure for transport. There is an extendable and retractable support leg extending through the orifice in the plate. A first joint is between the patient support structure and the support leg and a second joint is between the base and the support leg. The orifice is configured to limit the motion of the base relative to the support leg.

Still another surgical table extension in accordance with this invention features a patient support structure, a base, a support leg extending between the patient support structure and the base, and an integral cart for transporting and storing the table extension. In one example, the integral cart includes wheels offset upwardly from the base and a shelf for supporting the patient support structure. There is a plate attached to the base including an orifice therethrough through which the support leg extends. The plate terminates in the shelf.

Still another a surgical table extension in accordance with the subject invention features a patient support structure formed in two sections articulatable with respect to each other. There is a base and a support leg extending between one section of the patient support structure and the base.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
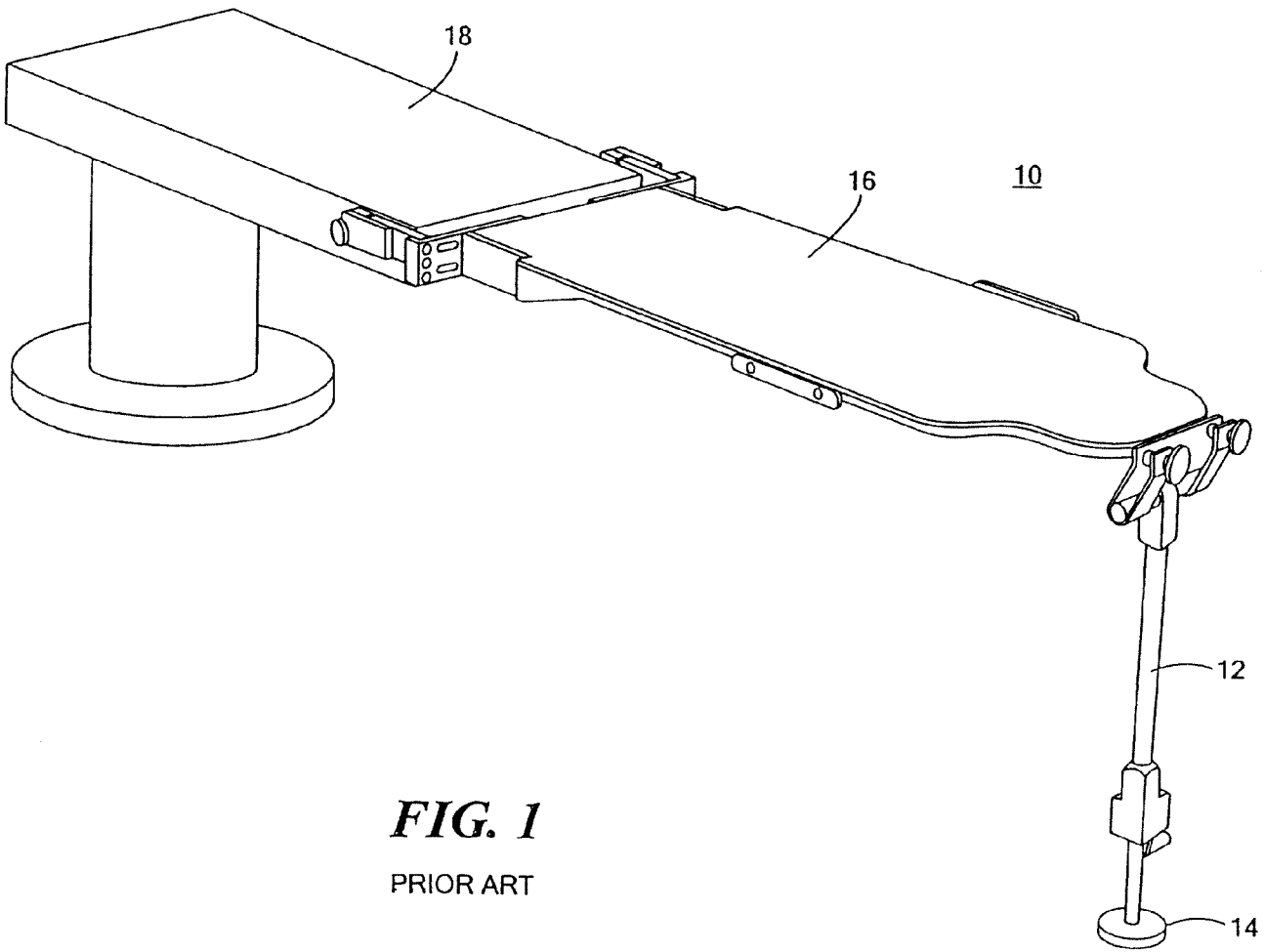
FIG. 1 PRIOR ART
FIG. 1 is a schematic three-dimensional view showing one prior art surgical table extension.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows prior art surgical table extension 10 sold by the applicant hereof including support leg 12 and small area base 14 supporting patient support platform 16 attached to the end of standard surgical table 18.

Figure 2:
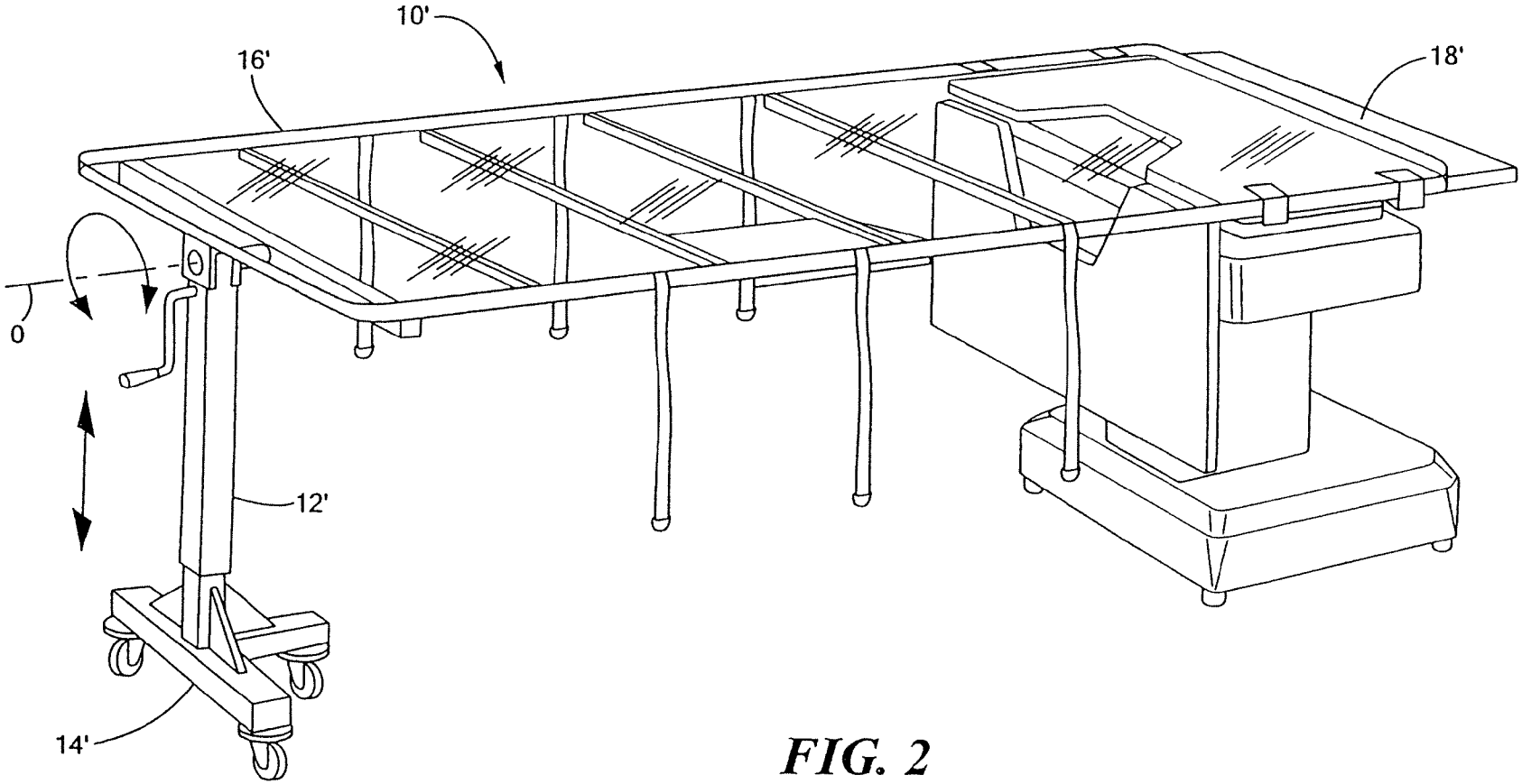
FIG. 2 PRIOR ART
FIG. 2 is a schematic three-dimensional view showing another prior art surgical table extension.

FIG. 2 depicts the surgical table extension of U.S. Pat. No. 4,995,067 including support leg 12' and wheeled base 14' supporting patient support platform 16' attached to the end of standard surgical table 18'.

As delineated in the Background section above, for certain medical procedures, it is desirable that table extension tilt laterally and also flex upwardly and downwardly all the while providing adequate support for the patient. An optimal design would allow the table extension to be stored compactly, easily transported to the surgical table and secured thereto, and easily dismantled, folded, and transported back to storage. The prior art table extensions shown in FIGS. 1 and 2 do not meet all of these desirable requirements.

Figure 3:
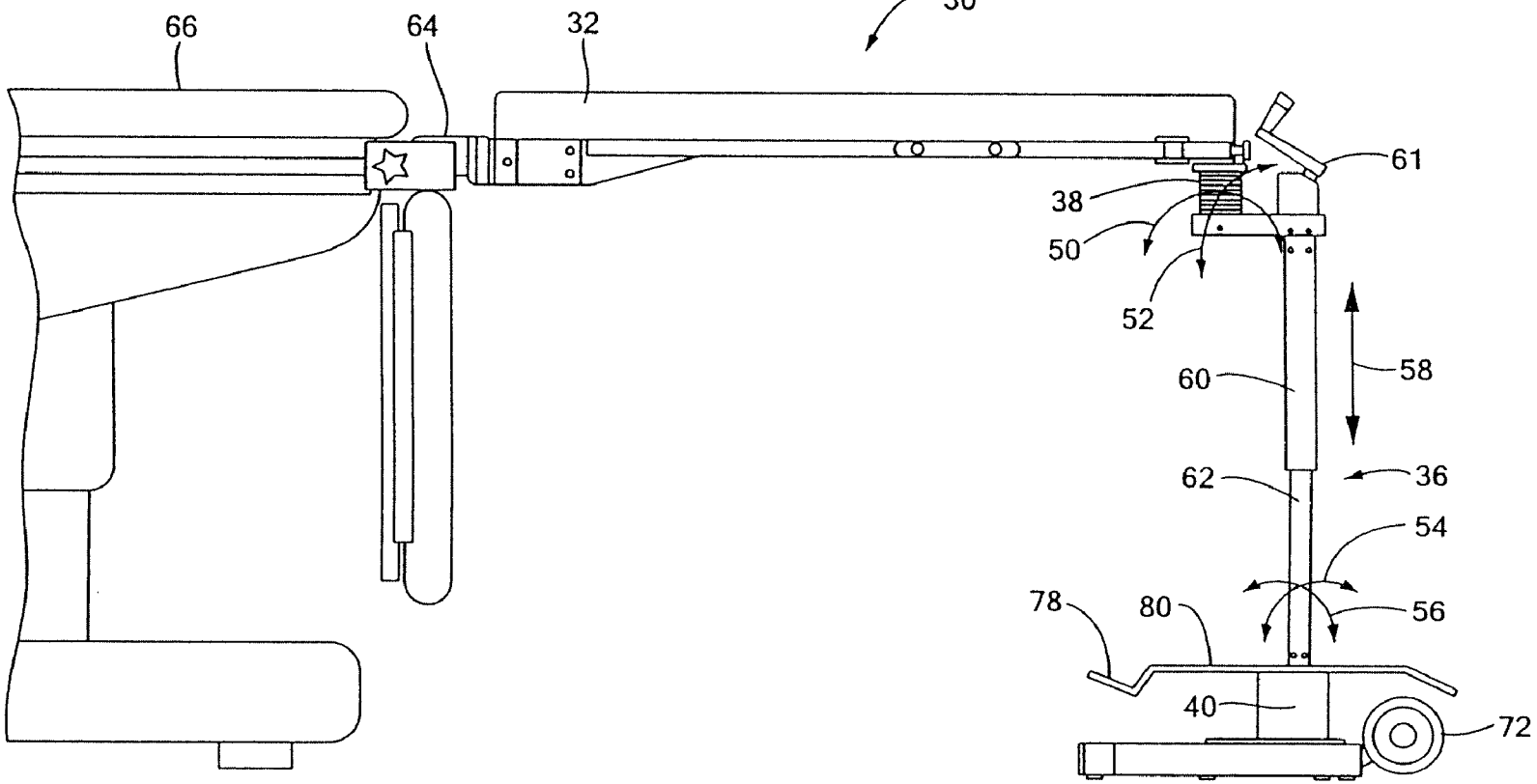
FIG. 3 is a side view showing one example of a surgical table extension in accordance with the subject invention.

Surgical table extension 30, FIG. 3 in accordance with this subject invention, features a patient support structure in the form of platform 32, large area base 34, and support leg 36. Large area base 34 provides for at least a three point contact with the floor. Upper joint 38, preferably a U-joint, has at least two degrees of freedom and interconnects patient support structure 32 and support leg 36. Lower joint 40, also preferably a U-joint and also having at least two degrees of freedom, interconnects support leg 36 and base 34. In one preferred embodiment, a stop limits the range of motion of base 34 such that a portion of the base area is constrained to be below upper joint 38 irrespective of the position of the base. In this way, adequate patient support is provided irrespective of the lateral tilt or flex position of the table and base 34 cannot be accidentally placed or kicked out into a position whereby the extension table is no longer able to support a patient. Support leg 36 is also designed so that the support leg does not suffer from moments or other loads which could lead to failure to adequately support a patient. The arrangement of the joints and the stop allows the extension to tilt when the axis of rotation of the table is not coincident with the axis of rotation at the extension.

Upper joint 38 allows movement in the direction shown by arrows 50 and 52; lower joint 40 allows movement in the direction shown by arrows 54 and 56; and leg 36 is extendable and retractable up and down as shown by arrows 58 by virtue of three telescoping sections two of which are shown in FIG. 3 at 60 and 62. Crank mechanism 61 extends and retracts the telescoping sections. A mechanism such as clamp attachment 64 releasably attaches patient support structure 32 to surgical table 66.

Figure 4:
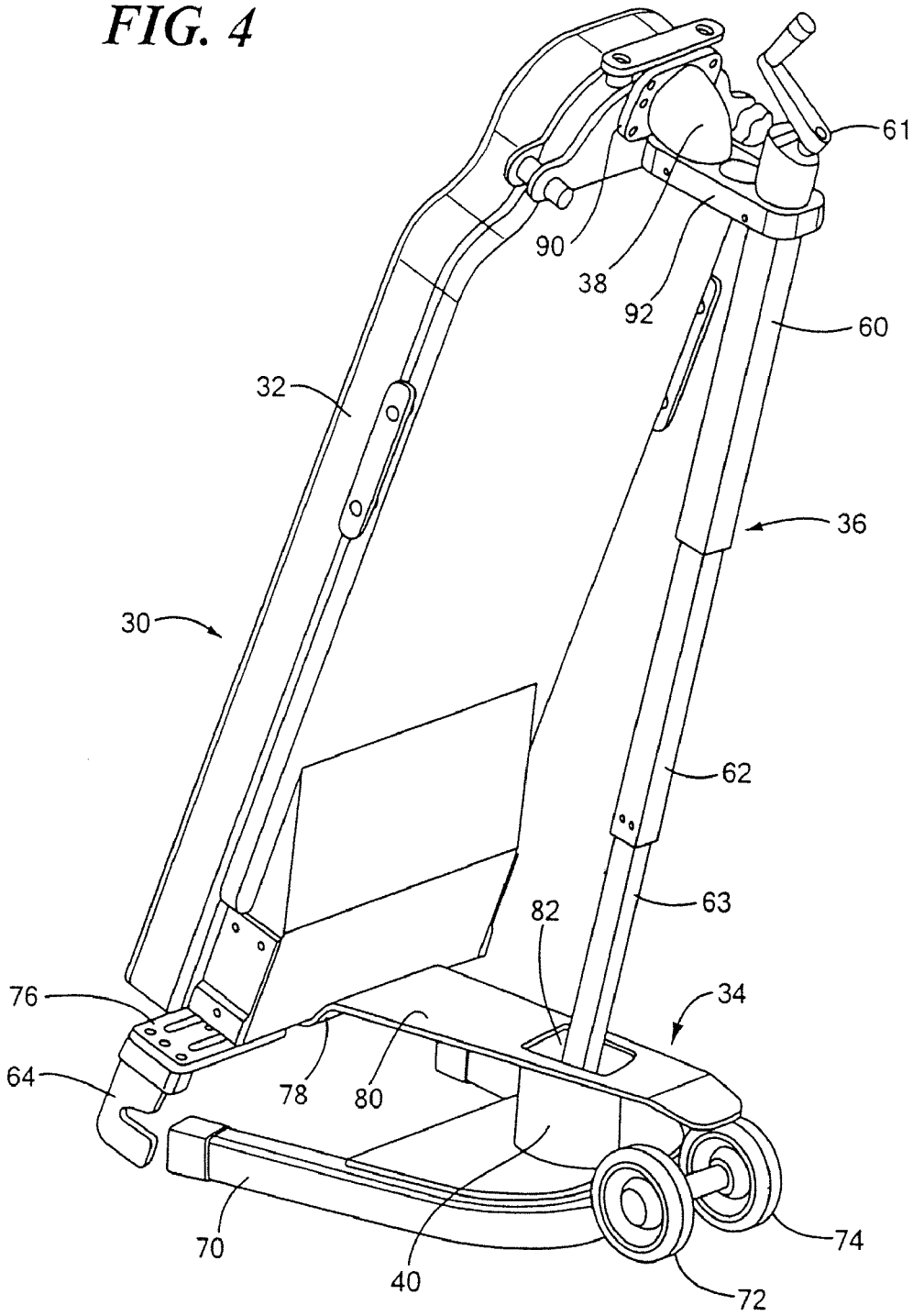
FIG. 4 is a schematic three-dimensional view showing the surgical table extension of FIG. 3 folded for transport.

One feature of extension 30 as shown in FIG. 4 is that it includes an integral cart for easy transport of the extension to and from a surgical table. Large area base 34 includes U-shaped bottom member 70 with wheels 72 and 74 offset upwardly. Extension 30 is designed so that when telescoping cylinders 60, 62, and 63 are extended, patient support structure 30 can be folded down so that end 76 rests on shelf 78 of base plate 80. This compact configuration can then be transported and stored when tipped rearwardly on wheels 72 and 74. See also FIG. 11.

Figure 5:
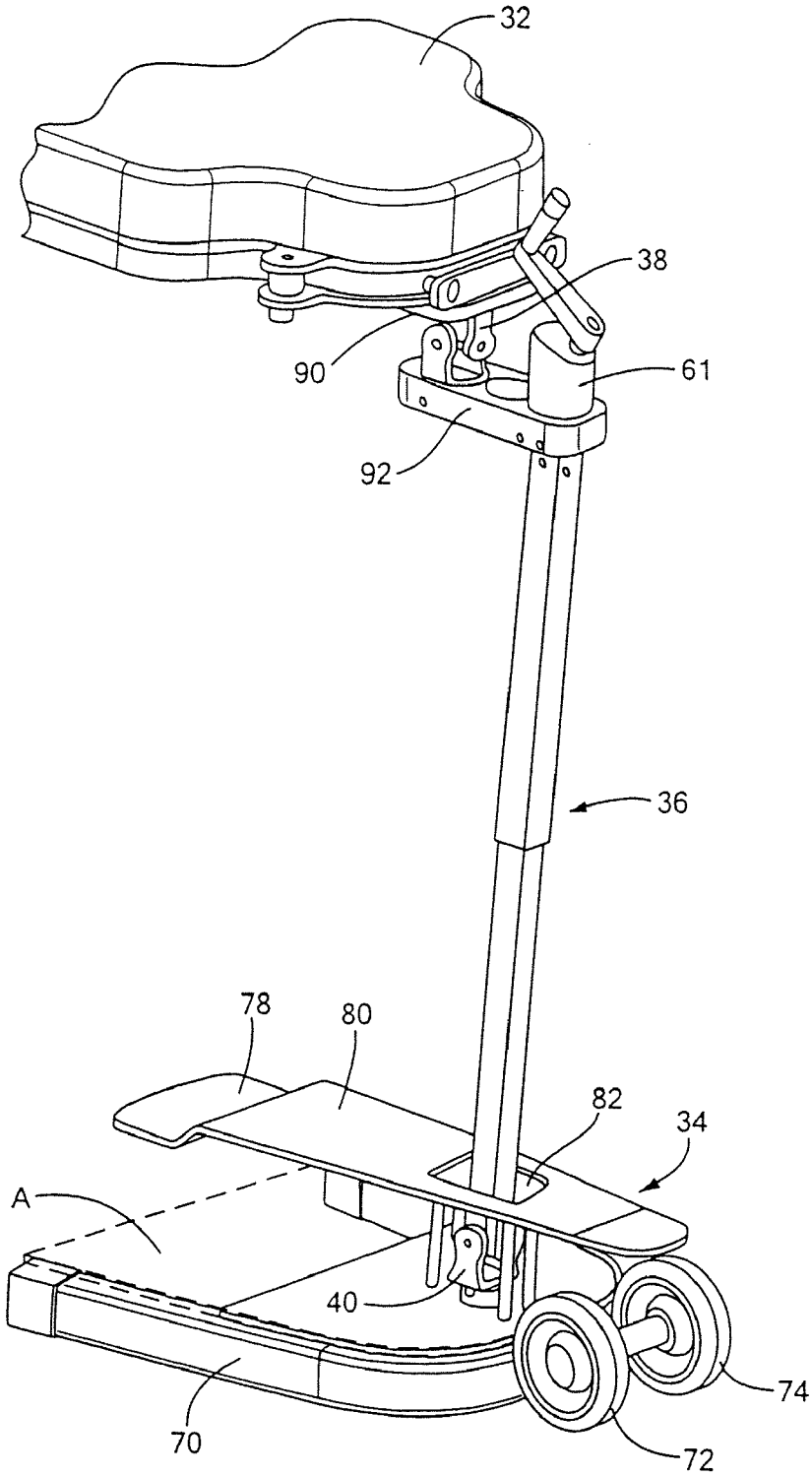
FIG. 5 is a partial schematic three-dimensional view showing in more detail the upper and lower U-joints of the surgical table extension shown in FIGS. 3 and 4.

Base plate 80, FIGS. 4-5 includes orifice 82 through which support leg 36 extends. The stop referred to above is defined by the size and/or configuration of this orifice to limit the travel of leg 36 as discussed below. Also, in this particular example, upper joint 38 is attached between bracket structure 90 fixed to patient support structure 32 and bracket structure 92 fixed to leg 36.

Figure 6:
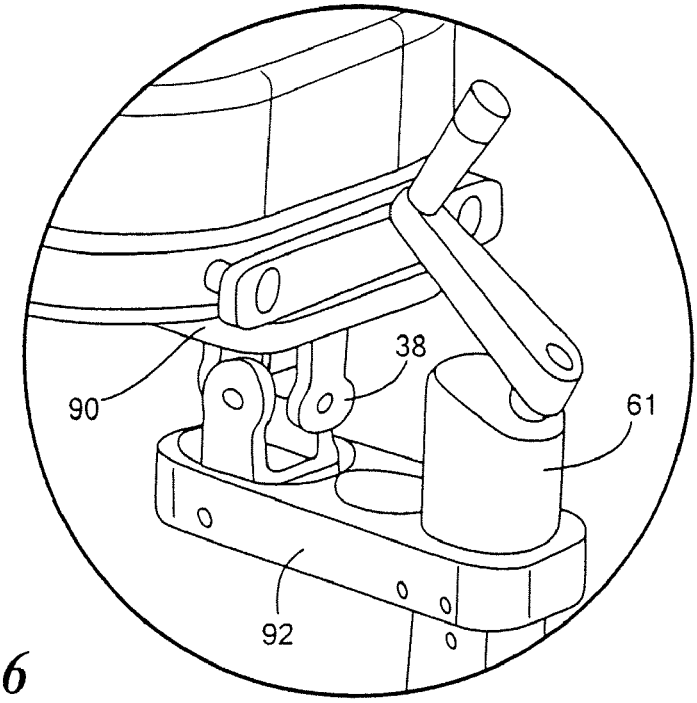
FIG. 6 is a schematic three-dimensional view showing in more detail the upper U-joint of FIG. 5.
Figure 7:
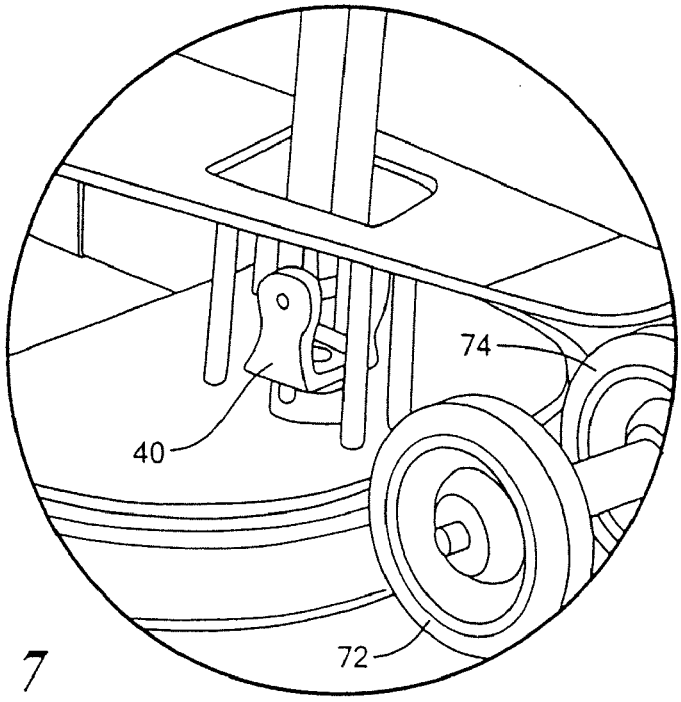
FIG. 7 is a schematic three-dimensional view showing in more detail the lower U-joint of FIG. 5.

FIGS. 5-7 show in more detail upper 38 and lower 40 U-joints and also stop plate 80 orifice 82 which limits the travel of leg 36 with respect to base 34 and vice versa. In this way, a portion of the area A defined by base 34 (as shown by the dashed lines) is constrained to be below first upper joint 38 irrespective of the position of leg 36. Area A is typically approximately 400 square inches and orifice 82 allows a maximum forward tilt of leg 36 of 20 degrees, a maximum rearward tilt of leg 36 of 17 degrees, and a side to side tilt of approximately .+−0.5 degrees.

Figure 8:
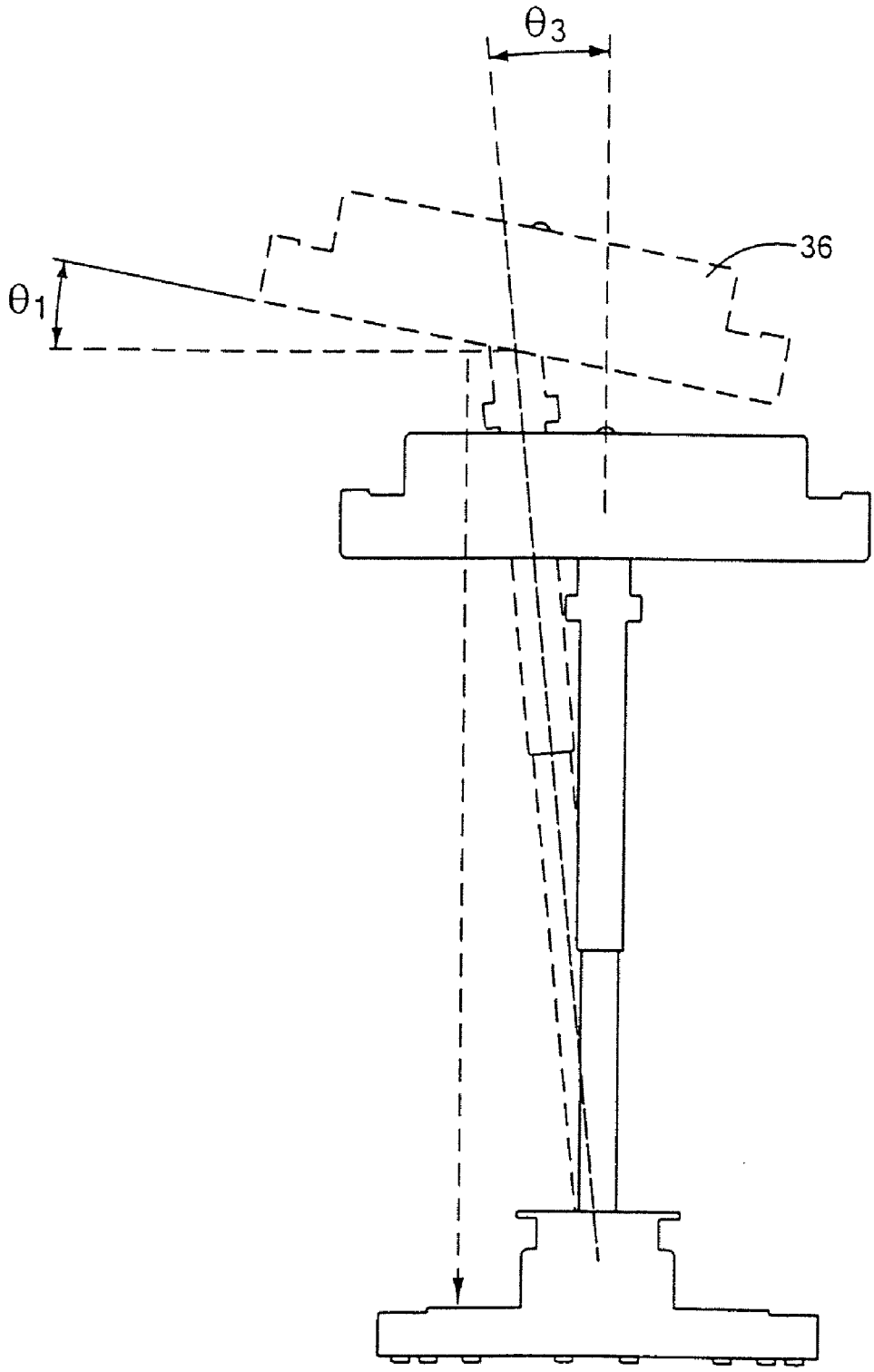
FIG. 8 is a front schematic view showing how the patient platform of the surgical table extension of the subject invention can be tilted laterally and the corresponding tilt angle of the support leg.
Figure 9:
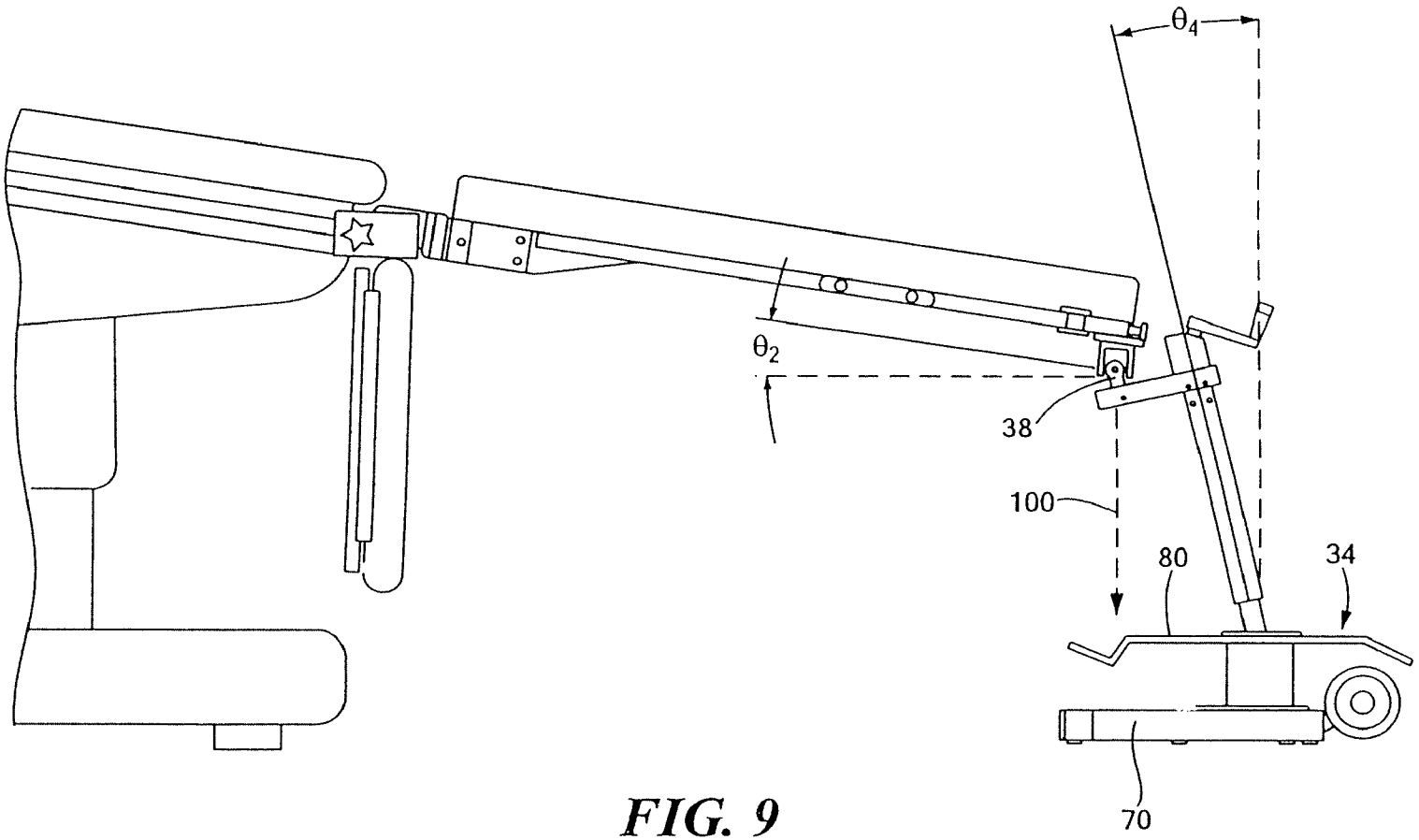
FIG. 9 is a schematic side view showing the support leg tilted forward and the patient support structure angled downward.
Figure 10:
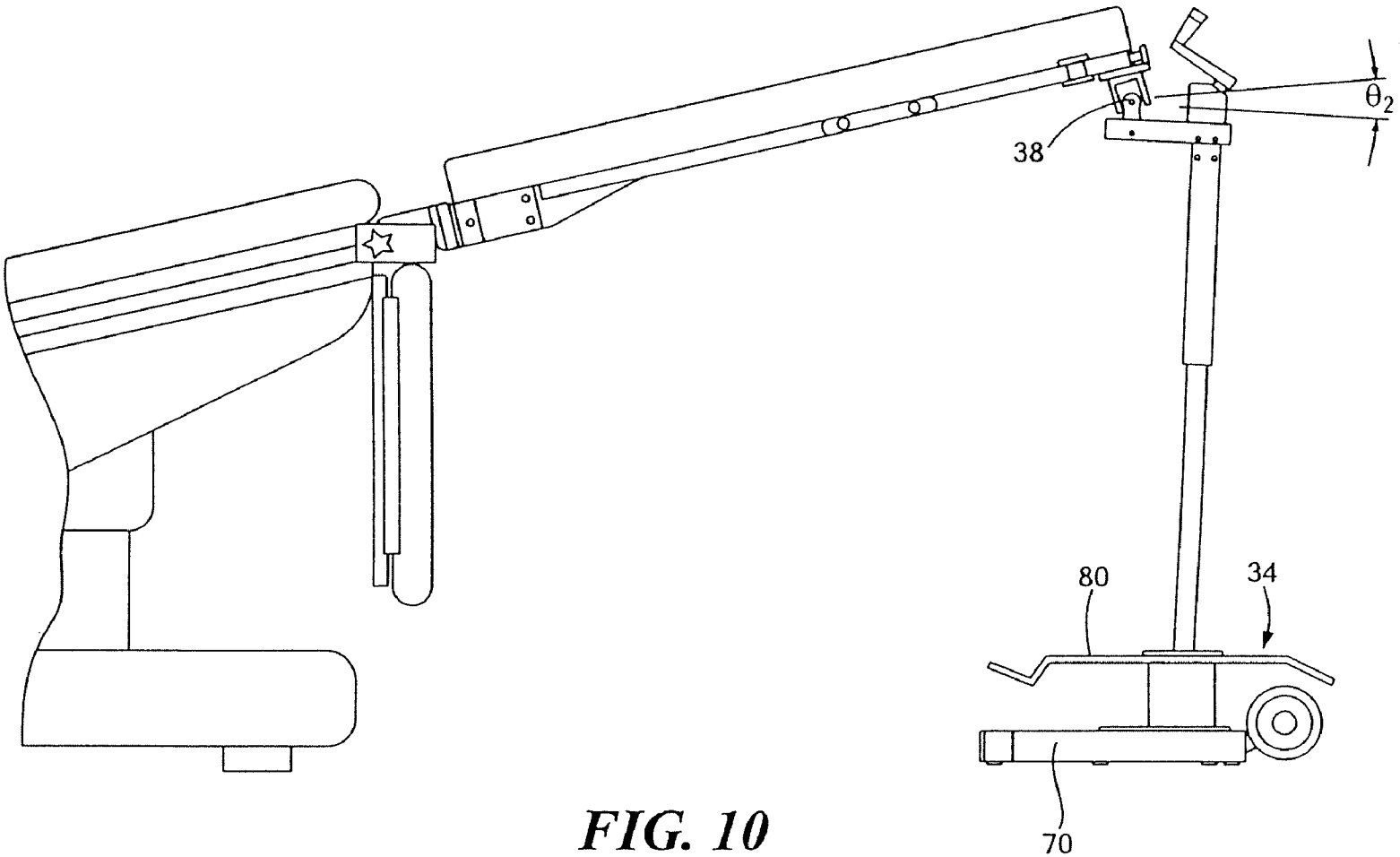
FIG. 10 is a schematic side view showing the patient support structure angled upward.

The various positions achievable by the table extension is shown in one example in FIGS. 8-9 where: support structure 36 is angled at yaw angle $\theta_1$ (e.g., 20°) and at a negative "Trendelenburg" tilt angle $\theta_2$; leg 36 is angled to the left at angle $\theta_3$ and forward at angle $\theta_4$; and still upper joint 36 is disposed above the base area as shown at 100 providing adequate support for even a 400 lb patient. FIG. 10 shows a positive tilt angle $\theta_2$ or a reverse Trendelenburg position.

Figure 11:
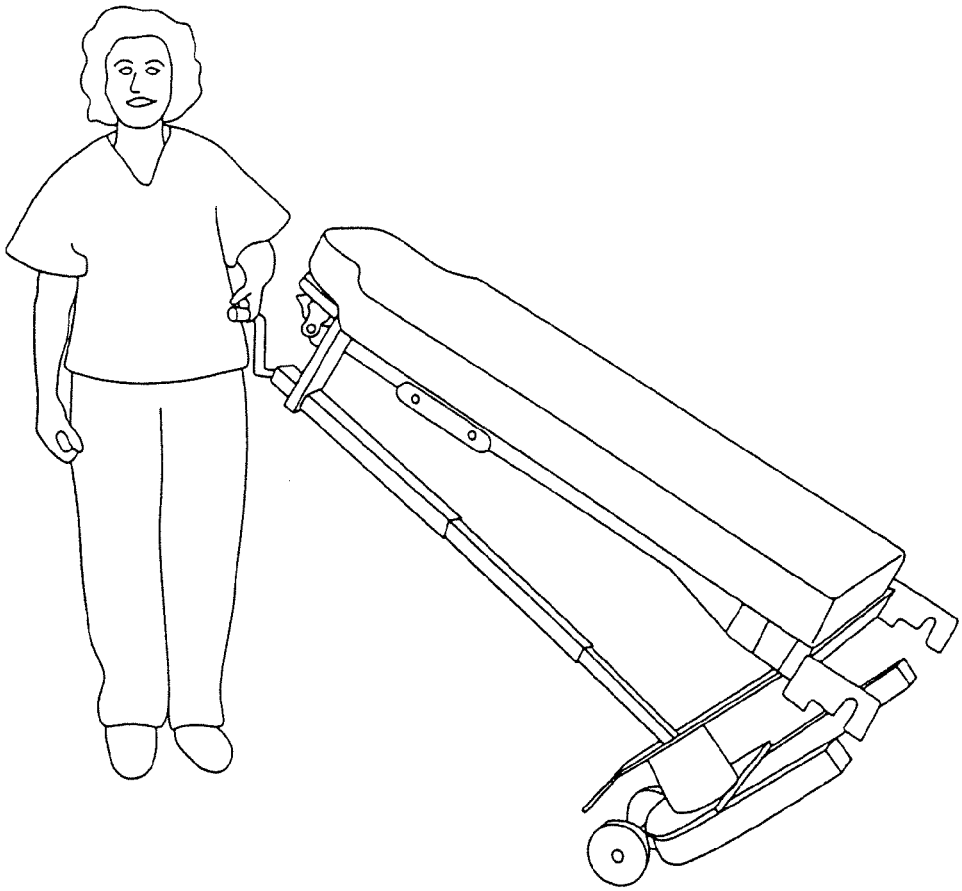
FIGS. 11-14 are schematic three-dimensional views showing how the surgical table extension of the subject invention can be transported and easily and quickly attached to a surgical table in accordance with the subject invention.
Figure 12:
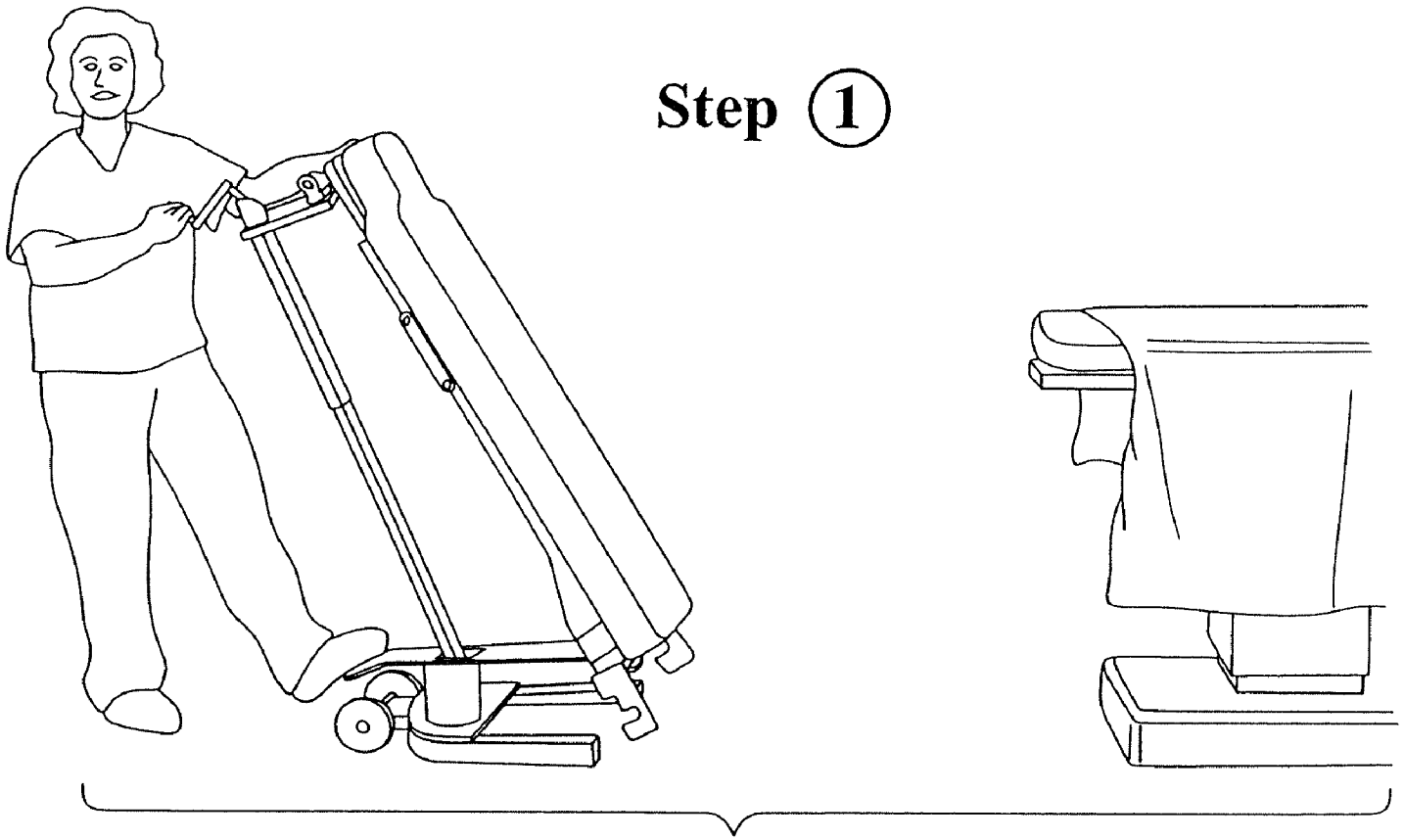
Figure 13:
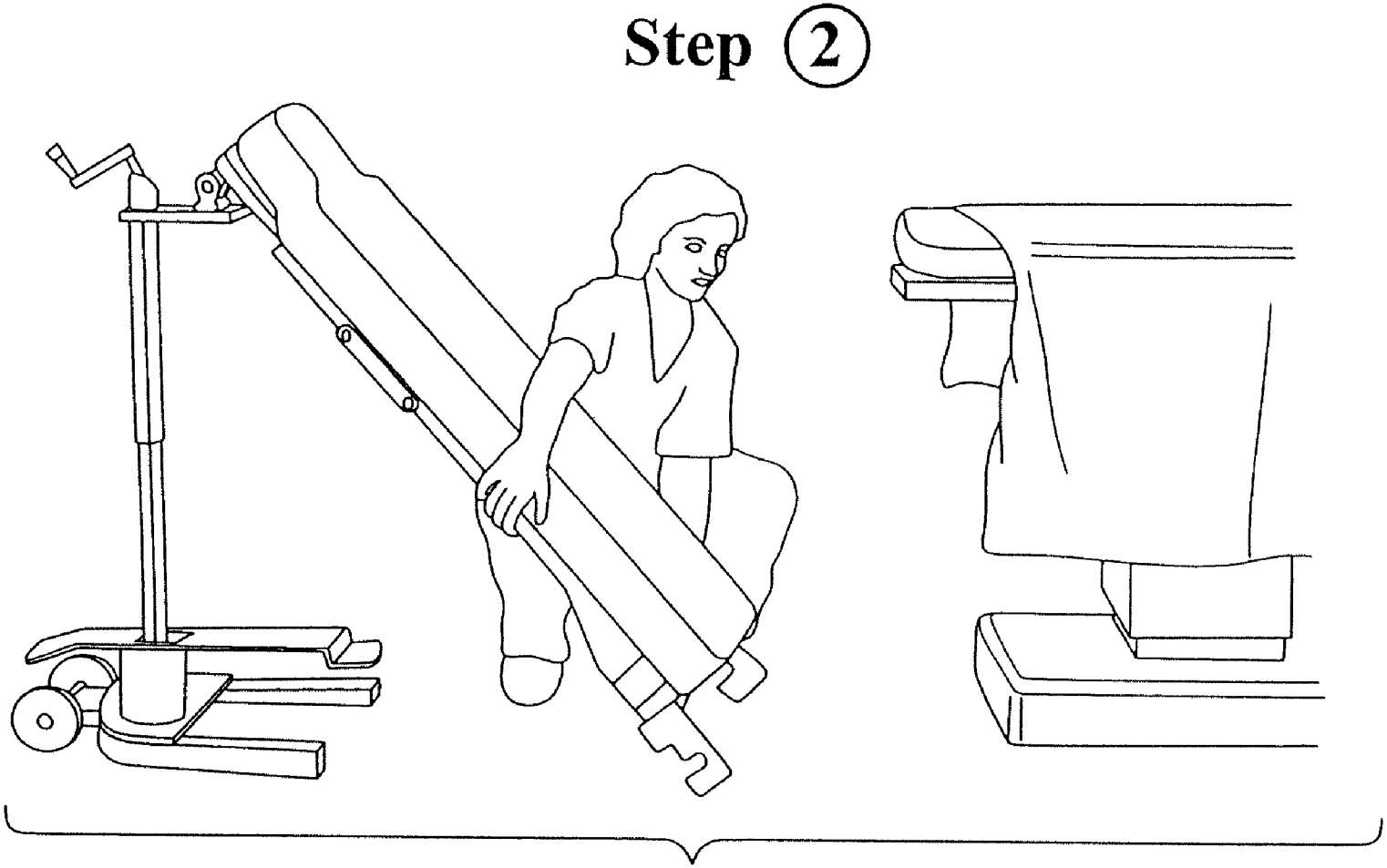
Figure 14:
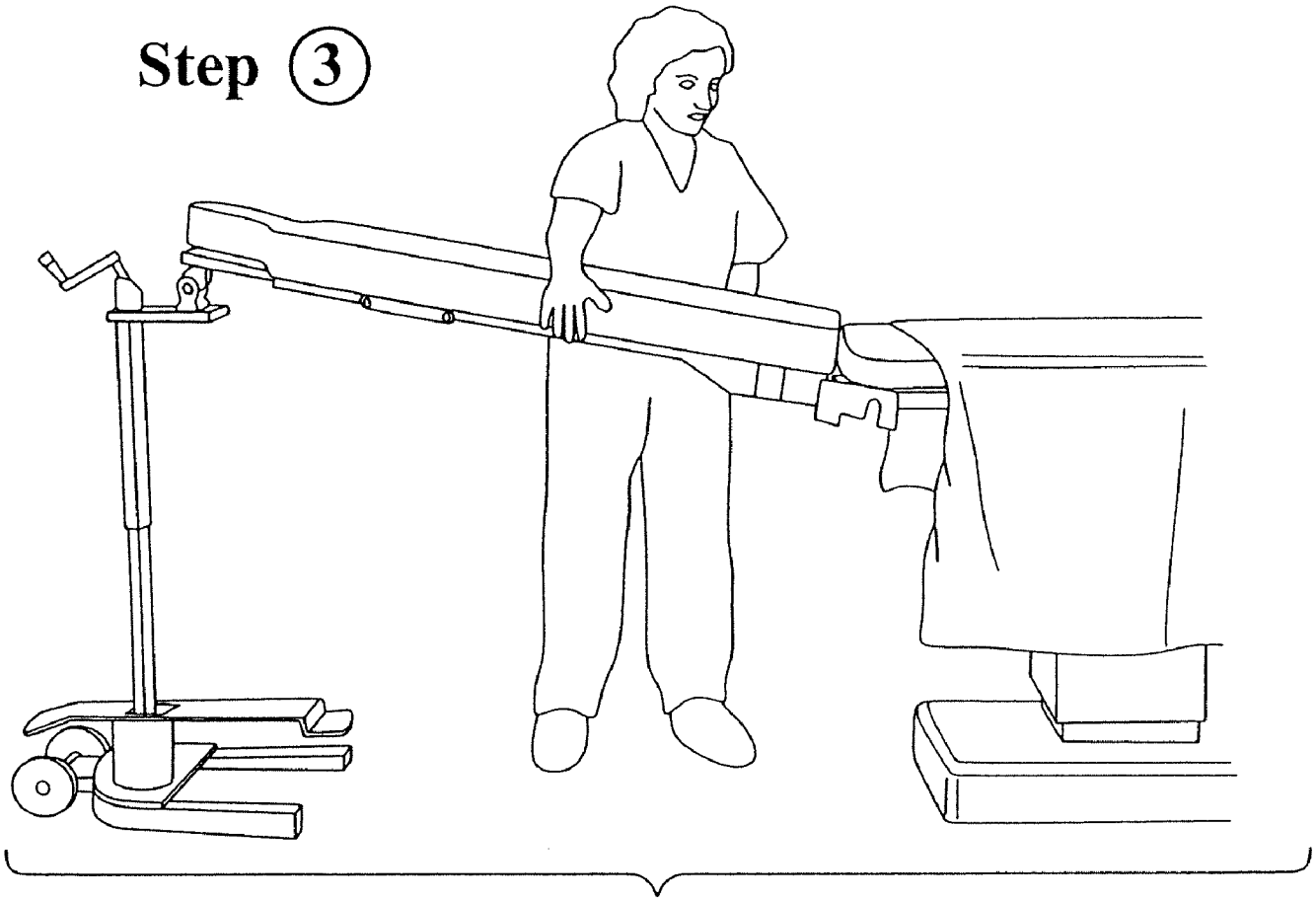

FIGS. 11-14 show how table extension 30 can be easily transported, FIGS. 11, 12, and unfolded, FIG. 13, and then attached to a surgical table, FIG. 14.

Figure 15:
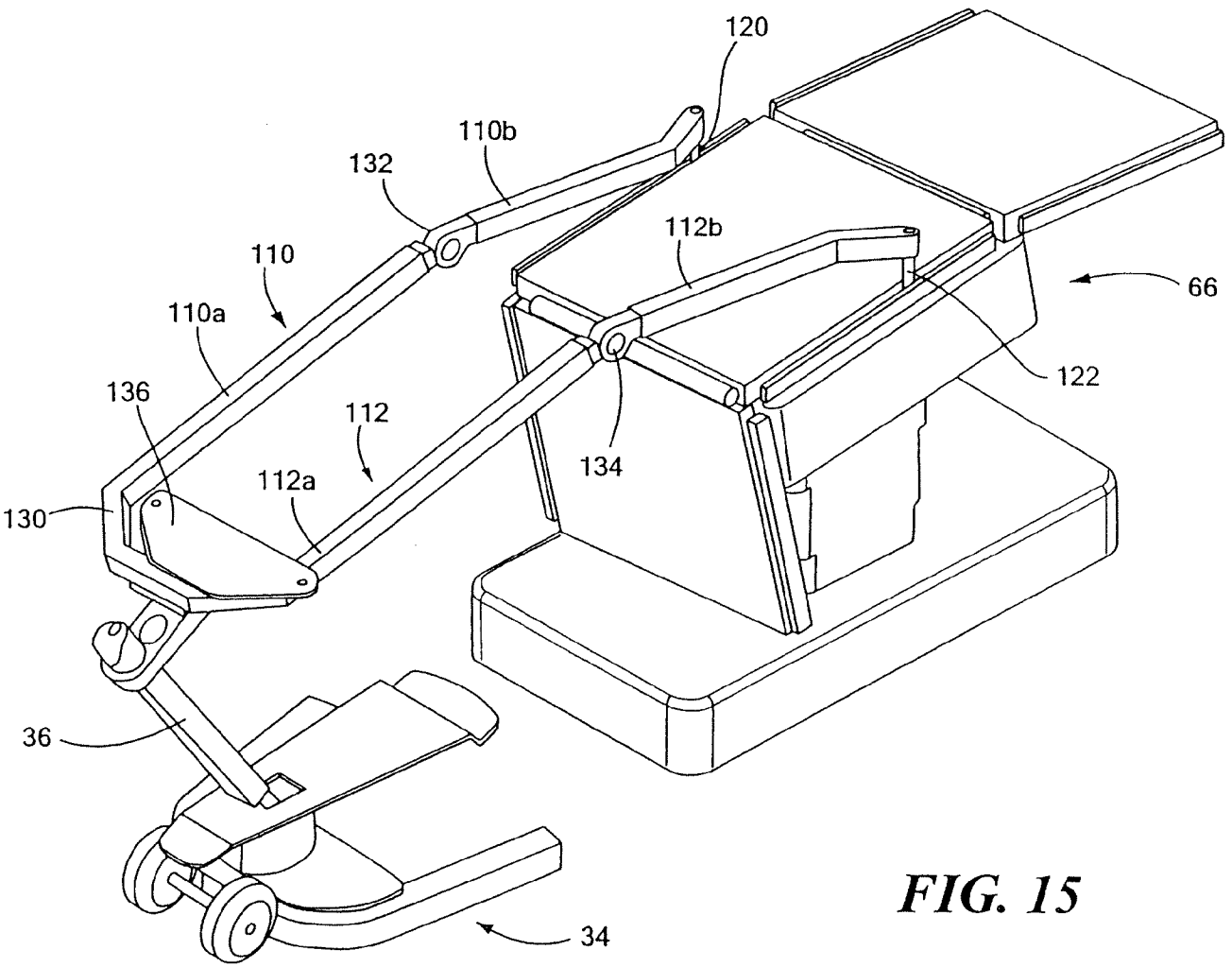
FIG. 15 is a schematic three-dimensional view showing another example of a surgical table extension in accordance with the subject invention.
Figure 16:
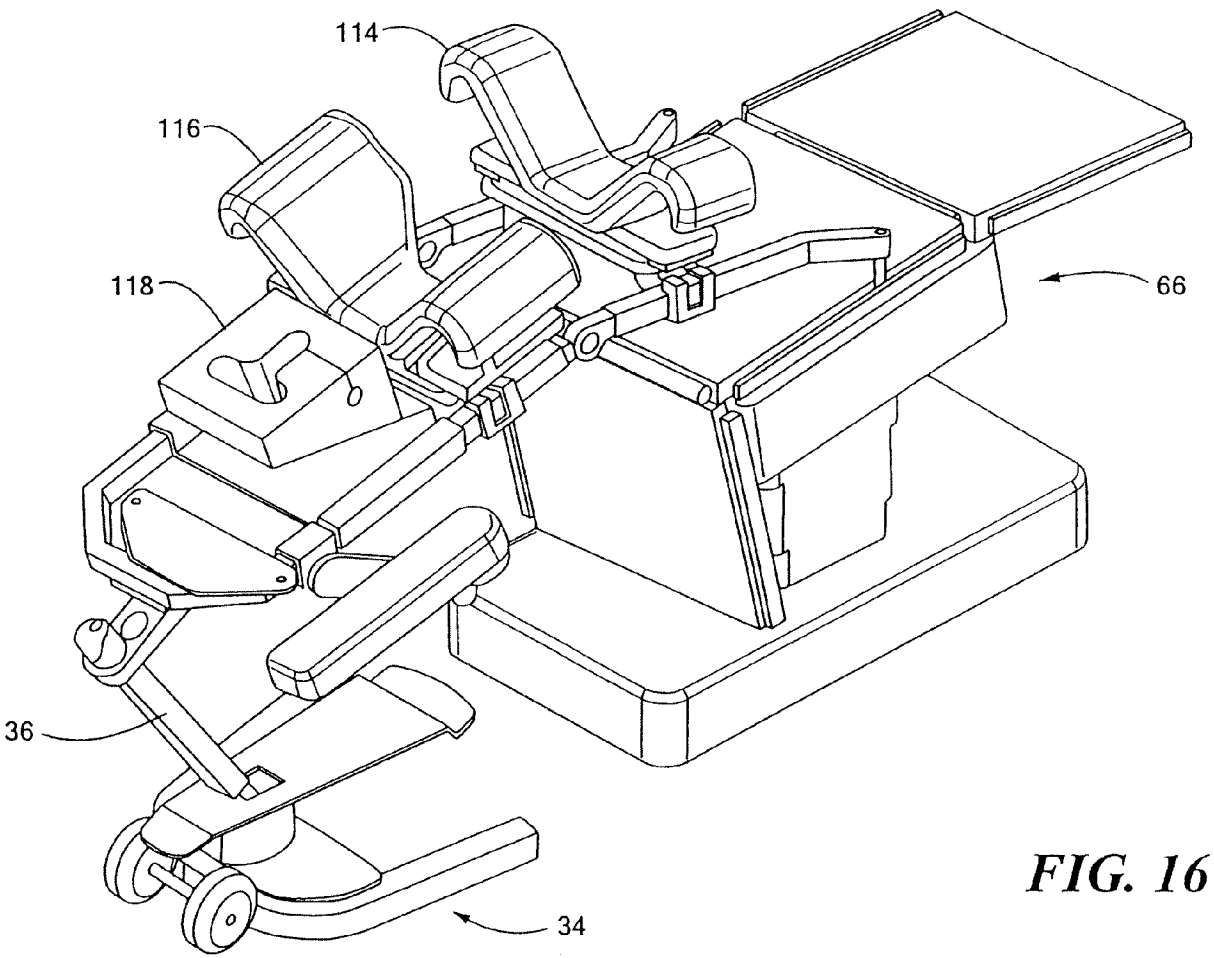
FIG. 16 is a schematic three-dimensional view showing the surgical table extension of FIG. 15 fitted with patient support pads.

FIGS. 15, 16 depict another embodiment where the patient support structure includes opposing beams 110 and 112 joined by bracket 130. Support pads 114, 116, and 118 can be attached to beams 110 and 112. Posts 120 and 122 serve as the mechanism to attach the extension to a surgical table when they are inserted into the rails of surgical table 124. Preferably, each beam is in two sections 110*a* and 110*b* and 112*a* and 112*b* each joined together by a pivoting axle joint 132 and 134, respectively, so that head end 136 can be raised and lowered.

Figure 17:
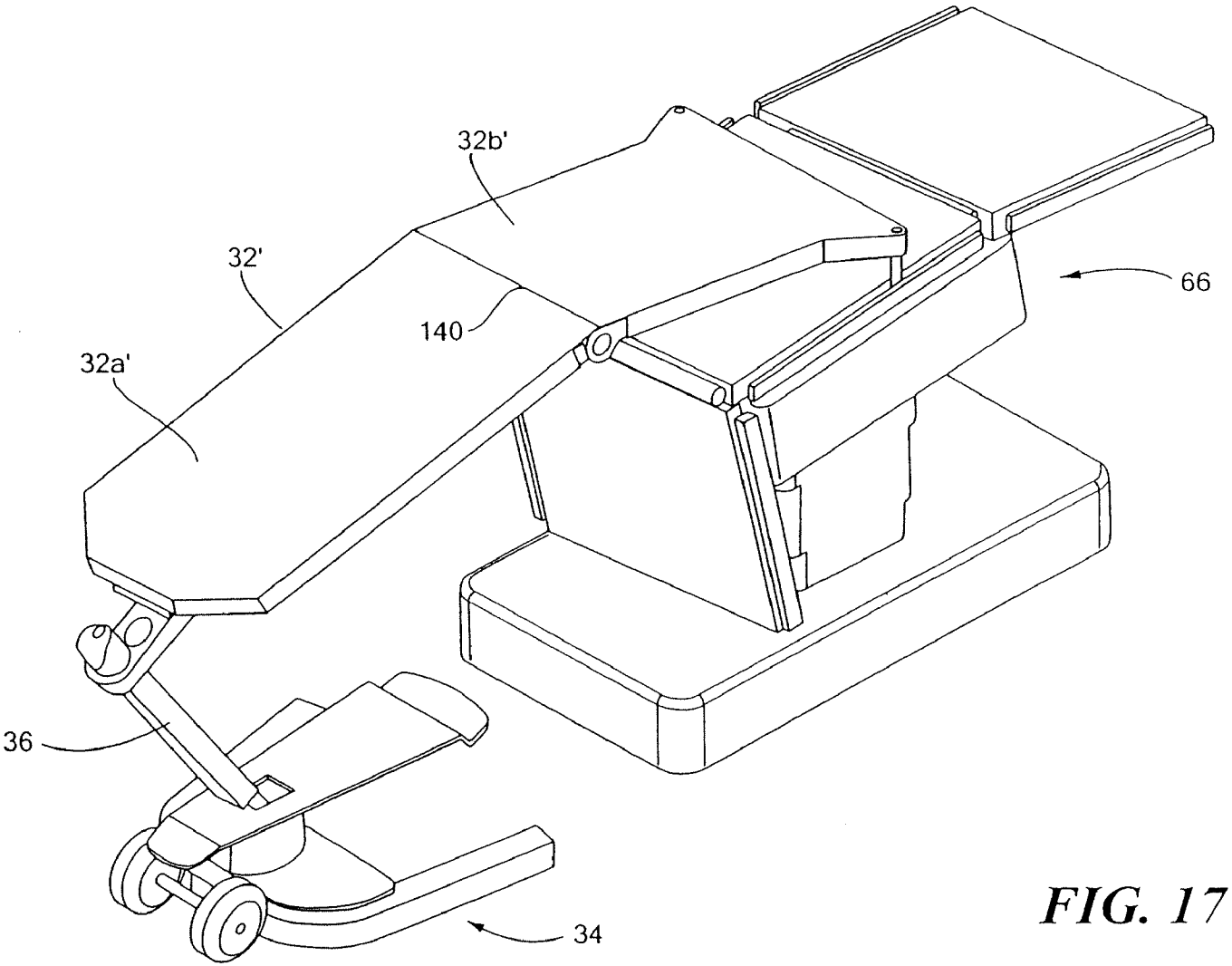
FIG. 17 is a schematic three-dimensional view showing still another example of a surgical table extension in accordance with the subject invention.

FIG. 17 shows still another embodiment wherein patient support platform 32' includes two articulable sections 32*a'* and 32*b'* joined together by pivoting axle joint 140.

The result in any embodiment is a sturdy design wherein the extension table is capable of supporting a 400 lb patient irrespective of the lateral tilt angle of the patient support structure or the upward or downward tilt thereof. The wide area base with the limiting stop discussed above makes it highly unlikely that the base can be kicked out into a position where it would no longer adequately support a patient. Large moments or other loads are prevented from being imposed on the support leg. The patient support structure, typically 48 inches in length, provides good C-arm access during X-ray imaging. The integral cart allows for easy transportation and simple set up. Up to 20° of lateral tilt is provided for improved surgical site access. The patient can be lowered for improved surgical site access during spinal procedures and Trendelenburg, reverse Trendelenburg, and flex positions are easily attained. The surgical table extension of the subject invention is easy to transport, easy to affix to a surgical table, and also easy to dismantle therefrom.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

The invention claimed is:

1. A surgical table extension for use with a surgical table, the surgical table extension comprising:

a patient support structure;

a base defining a base area;

a support leg having extendable and retractable sections;

a first joint having at least two degrees of freedom coupled to the patient support structure and to the support leg;

a second joint having at least two degrees of freedom coupled to the base and to the support leg, the range of motion of the support leg relative to the base being such that a portion of the base area is constrained to be below the first joint irrespective of the angular position of the support leg relative to the base;

at least one clamp configured to couple the patient support structure to at least one surgical rail situated along a side of the surgical table; and a hand crank that is usable to extend and retract the extendable and retractable sections.

2. The surgical table extension of claim 1, wherein the first and second joints comprise U-joints.

3. The surgical table extension of claim 1, wherein the patient support structure includes a first bracket, there is a second bracket attached to the support leg, and the first joint is disposed between the first and second brackets.

4. The surgical table extension of claim 1, wherein the base includes a U-shaped bottom.

5. The surgical table extension of claim 1, wherein the base includes wheels.

6. The surgical table extension of claim 5, wherein the wheels are offset upwardly on the base for transporting the table extension when the base is tilted.

7. The surgical table extension of claim 1, further comprising a shelf configured to support the patient support structure when the patient support structure is folded proximate the support leg.

8. The surgical table extension of claim 1, wherein the extendable and retractable sections of the support leg includes a plurality of telescoping sections.

9. The surgical table extension of claim 1, wherein the at least one clamp mechanism comprises two clamp mechanisms situated on opposite sides of the patient support structure, the clamp mechanisms coupling to surgical rails on opposites of the surgical table such that, when the patient support structure is coupled to the surgical table, the patient support structure extends longitudinally beyond an end of the surgical table to increase a patient support area lengthwise with respect to the surgical table.

10. The surgical table extension of claim 1, wherein the base includes a plate and the plate has an orifice through which the support leg extends.

11. The surgical table extension of claim 10, wherein a configuration of the orifice defines a stop that limits the range of motion of the support leg relative to the base.

12. An apparatus for supporting a patient during surgery, the apparatus comprising:

a surgical table having at least one rail that extends longitudinally along a side of the surgical table, and a surgical table extension comprising a patient support structure, a base defining a base area; a support leg having extendable and retractable sections; a first joint having at least two degrees of freedom coupled to the patient support structure and to the support leg; a second joint having at least two degrees of freedom coupled to the base and to the support leg, the range of motion of the support leg relative to the base being such that a portion of the base area is constrained to be below the first joint irrespective of the angular position of the support leg relative to the base; at least one clamp configured to couple the patient support structure to at the least one surgical rail of the surgical table; and a hand crank that is usable to extend and retract the extendable and retractable sections.

13. The apparatus of claim 12, wherein at least one of the first and second joints comprises a U-joint.

14. The apparatus of claim 12, wherein the base includes wheels.

15. The apparatus of claim 14, wherein the wheels are offset upwardly on the base for transporting the table extension when the patient support section is uncoupled from the surgical table and the base is tilted.

16. The apparatus of claim 12, further comprising a shelf configured to support the patient support structure when the patient support structure is uncoupled from the surgical table and folded proximate the support leg.

17. The apparatus of claim 12, wherein the extendable and retractable sections of the support leg includes a plurality of telescoping sections.

18. The apparatus of claim 12, wherein the at least one surgical rail comprises two surgical rails on opposite sides of the surgical table, the at least one clamp mechanism comprises two clamp mechanisms situated on opposite sides of the patient support structure, the clamp mechanisms coupling to the surgical rails on opposites of the surgical table such that, when the patient support structure is coupled to the surgical table, the patient support structure extends longitudinally beyond an end of the surgical table to increase a patient support area lengthwise with respect to the surgical table.

19. The apparatus of claim 12, wherein the base includes a plate and the plate has an orifice through which the support leg extends.

20. The apparatus of claim 19, wherein a configuration of the orifice defines a stop that limits the range of motion of the support leg relative to the base.

* * * * *